US008945442B2

(12) United States Patent
Rosati

(10) Patent No.: US 8,945,442 B2
(45) Date of Patent: Feb. 3, 2015

(54) CONCRETE FORMWORK FRAME ASSEMBLY AND METHOD OF STRIPPING CONCRETE FORMWORK FROM A CONCRETE SURFACE

(76) Inventor: Wasyl Rosati, Cheltenham (AU)

( * ) Notice: Subject to any disclaimer, the term of this patent is extended or adjusted under 35 U.S.C. 154(b) by 247 days.

(21) Appl. No.: 13/132,439

(22) PCT Filed: Dec. 4, 2008

(86) PCT No.: PCT/AU2008/001792

§ 371 (c)(1),
(2), (4) Date: Jun. 2, 2011

(87) PCT Pub. No.: WO2010/063056

PCT Pub. Date: Jun. 10, 2010

(65) Prior Publication Data

US 2011/0316199 A1 Dec. 29, 2011

(51) Int. Cl.

| | |
|---|---|
| ***E04G 21/02*** | (2006.01) |
| ***E04G 11/48*** | (2006.01) |
| ***E04G 19/00*** | (2006.01) |
| ***E04G 11/38*** | (2006.01) |

(52) U.S. Cl.

CPC ..... *E04G 11/48* (2013.01); *E04G 21/02* (2013.01); *E04G 19/003* (2013.01); *E04G 11/38* (2013.01)

USPC ..... 264/33

(58) Field of Classification Search

CPC ..... E04G 11/48; E04G 21/02

USPC ..... 249/18, 26, 27, 28; 52/745.05, 745.06; 264/31, 33

See application file for complete search history.

(56) References Cited

U.S. PATENT DOCUMENTS

| | | | | | |
|---|---|---|---|---|---|
| 857,524 | A | * | 6/1907 | Hindman et al. | 249/29 |
| 1,498,665 | A | * | 6/1924 | Macivor | 249/18 |
| 2,671,697 | A | * | 3/1954 | North | 425/62 |
| 3,037,259 | A | * | 6/1962 | Dave | 425/62 |
| 3,190,405 | A | * | 6/1965 | Squire | 52/637 |
| 3,313,081 | A | * | 4/1967 | Squire | 52/645 |

(Continued)

FOREIGN PATENT DOCUMENTS

| | | | |
|---|---|---|---|
| CN | 201133076 | Y | 10/2008 |
| EP | 0105504 | A1 | 4/1984 |

(Continued)

OTHER PUBLICATIONS

Written Opinion for International Application No. PCT/AU2008/001792 dated Feb. 11, 2009.

(Continued)

*Primary Examiner* — Michael Safavi
(74) *Attorney, Agent, or Firm* — Alston & Bird LLP

(57) ABSTRACT

This disclosure relates to a frame for use with formwork to support the formwork for concrete casting and for stripping formwork from a concrete surface. The formwork is secured to the frame assembly such that the level at which the formwork is supported by the framework is adjustable so as to be movable between at least a first level above a floor surface selected for concrete casting, and a second level where the formwork is either away from the cured concrete (i.e. stripped) or unsupported by the frame assembly. The disclosure provides a means of both supporting formwork during concrete casting as well as a means of stripping the formwork after the concrete is cast. An associated method is also disclosed.

12 Claims, 7 Drawing Sheets

(56) References Cited

U.S. PATENT DOCUMENTS

| | | | | | |
|---|---|---|---|---|---|
| 3,329,105 | A | * | 7/1967 | McPherson | 108/4 |
| 3,420,030 | A | * | 1/1969 | Kosmach et al. | 52/637 |
| 3,520,508 | A | * | 7/1970 | Tooley et al. | 249/18 |
| 3,604,175 | A | * | 9/1971 | Gray | 52/637 |
| 3,822,853 | A | * | 7/1974 | Shelley | 249/27 |
| 3,826,057 | A | * | 7/1974 | Franklin | 52/641 |
| 3,902,289 | A | * | 9/1975 | Dashew | 52/126.7 |
| 3,940,105 | A | * | 2/1976 | Metrailer | 249/209 |
| 3,977,536 | A | * | 8/1976 | Moore et al. | 414/11 |
| 4,003,541 | A | * | 1/1977 | Lanier | 249/18 |
| 4,026,079 | A | * | 5/1977 | Morris | 52/126.7 |
| 4,036,466 | A | * | 7/1977 | Van Meter | 249/18 |
| 4,078,759 | A | * | 3/1978 | Lanier | 249/18 |
| 4,492,358 | A | * | 1/1985 | Manderla | 249/18 |
| 4,569,501 | A | * | 2/1986 | McCracken | 249/209 |
| 4,693,449 | A | * | 9/1987 | Cunningham | 249/210 |
| 4,787,183 | A | * | 11/1988 | Johnston | 52/126.4 |
| 5,338,498 | A | * | 8/1994 | Lefebvre | 264/31 |
| 5,616,349 | A | * | 4/1997 | Sasaki | 425/62 |
| 2003/0056463 | A1 | | 3/2003 | Pertoldi | |

FOREIGN PATENT DOCUMENTS

| | | | |
|---|---|---|---|
| GB | 1052097 | A | 12/1966 |
| JP | 4-020656 | A | 1/1992 |
| JP | 7-279417 | A | 10/1995 |
| JP | 04-293861 | | 10/1998 |
| RU | 2016994 | | 7/1994 |
| RU | 17054 | U1 | 3/2001 |
| SU | 673510 | | 7/1979 |
| UA | 9555 | U | 10/2005 |

OTHER PUBLICATIONS

Office Action for Japanese Application No. 2011-538792 dated Feb. 4, 2013.

Office Action for Russian Application No. 2011122961/03(034055) dated Apr. 26, 2013.

Office Action for Russian Application No. 2011122961/03(034055) dated Nov. 22, 2012.

* cited by examiner

CONCRETE FORMWORK FRAME ASSEMBLY AND METHOD OF STRIPPING CONCRETE FORMWORK FROM A CONCRETE SURFACE

This disclosure relates to a frame assembly for supporting concrete casting formwork, and a method of stripping the formwork from a formed concrete surface.

BACKGROUND

In this specification unless the contrary is expressly stated, where a document, act or item of knowledge is referred to or discussed, this reference or discussion is not to be construed as an admission that the document, act or item of knowledge or any combination thereof was at the priority date, publicly available, known to the public, part of common general knowledge; or known to be relevant to an attempt to solve any problem with which this specification is concerned.

In known building practice, formwork is assembled on a surface or on a lower floor level to form the next level of the building above. The formwork includes box forms to create columns, table forms to form concrete beams extending between the columns and lost formwork to fill the regions between the beams.

Lost formwork and the table forms are normally held in position by scaffolding. The scaffolding is assembled on to the surface or floor below with the lost formwork and table forms being supported on the scaffolding. The table forms are lowered in to position on to the scaffolding by cranes.

The lost formwork comprises rolled sheet metal sections which are left place after the concrete sets.

The table forms normally have plywood surfaces against which the concrete is poured. A series of joists are spaced along the underneath surface of the plywood and further bearers are located under the joists which locate on the scaffolding to support the formwork.

The scaffolding is strong enough to support concrete which is then poured on to the formwork to create the next floor above. Once this concrete is set, and becomes self supporting, then the scaffolding and formwork can be removed from beneath.

Normally, scissor lift mechanisms or platforms are used to support the table forms while the scaffolding is removed. The table form formwork is then prised away from the concrete surface and lowered to ground level. All the components are stacked for the removal from the building site by forklift and crane.

It has been proposed to use carriage systems to replace scaffolding for the purpose of raising and lowering of concrete formwork. An example of such a carriage system is illustrated in British Patent No. GB 1052097. According to this specification, the formwork can be raised to the required position and supported there while the concrete is poured on above. Once the concrete is set, then the concrete formwork is removed.

However, a significant problem with such a carriage system remains the adherence of the formwork to the cured concrete surface. Often, the formwork must still be manually prized away from the surface of the cured concrete. This is not only time consuming, but potentially hazardous for those doing the prizing.

It is an object of the present disclosure therefore to substantially ameliorate the above described difficulties, or at least to provide a formwork support arrangement that is a useful alternative to known arrangements.

Other objects and advantages of the present invention will become apparent from the following description, taking in connection with the accompanying drawings, wherein, by way of illustration and example, an embodiment of the present invention is disclosed.

For the purpose of this specification the word "comprising" means "including but not limited to", and the word 'comprises' has a corresponding meaning.

SUMMARY OF THE DISCLOSURE

Accordingly, in one aspect of this disclosure, there is a frame assembly for supporting concrete formwork, the formwork being secured to the frame assembly so that the level at which the formwork is supported by the framework is adjustable, the frame assembly comprising a plurality of spaced apart legs, and at least one adjustable foot assembly associated with at least one of the legs, the or each adjustable foot assembly being adapted to selectively extend or retract relative to its associated leg or legs.

In one form, there are at least three spaced apart legs, and an adjustable foot assembly located at or near each of the legs, each adjustable foot assembly being adapted to selectively extend or retract relative to its respective leg.

In one form, the or each foot assembly is adapted to provide for fine adjustment of this relative to its respective leg.

In one form, in an alternative, a cross bar may extend between a pair of legs, and at least one foot assembly is adapted to selectively extend or retract relative to this cross bar.

In one form, each foot assembly is adapted to provide for fine adjustment of this relative to its respective leg.

In one form, each foot assembly is adapted to be raised or lowered into or out of ground or floor engaging position.

In one form, the frame assembly defines an uppermost surface to which the formwork is secured, and this uppermost surface may be levelled by adjusting the foot assemblies.

In one form, the uppermost surface of the frame assembly is rectilinear and the frame assembly comprises a leg and foot assembly located at or toward each corner.

In one form, the frame comprises a lower frame portion that may be floor or ground engaging and an upper frame portion that is moveable up or down with respect to the lower frame portion.

In one form, the lower frame portion has four tubular legs and the upper portion has four legs, each one of which locates within and moves up and down telescopically with respect to a leg of the lower portion.

In one form, a hydraulic actuator is positioned between the upper and lower frames to move the upper frame portion relative to the lower frame portion.

In one form, two hydraulic actuators are provided at opposing sides of the frame.

In one form, the frame assembly further comprises ground engaging wheel assemblies that can be raised or lowered into or out of ground or floor engaging position, and which can support the frame to enable it to be moved when ground engaging.

In one form, there is a wheel assembly at or near each leg.

In one form, the wheels are castor wheels.

In a further aspect, the disclosure may include a method of stripping formwork from a cured concrete casting supported thereby whilst curing, the method employing a formwork supporting frame assembly as described above, the method being characterised in that it includes the steps of: retracting each foot relative to its respective leg until the formwork is unsupported by the frame assembly and may fall away from the cured concrete under the effect of the combined weight of the formwork and frame assembly.

In a further aspect the disclosure may include a frame assembly for supporting concrete formwork, where the formwork is secured to the frame assembly such that the level at which the formwork is supported by the framework is adjustable so as to be movable between at least a first level above a floor surface selected for concrete casting and a second level where the formwork is either away from the cured concrete or unsupported by the frame assembly.

In a further aspect the disclosure may include a method of stripping formwork from a cured concrete casting supported thereby whilst curing, the method employing a formwork supporting frame assembly as described directly above, the method being characterised in that it includes the steps of adjusting the level at which the formwork is supported by the frame assembly until the formwork is unsupported by the frame assembly and may fall away from the cured concrete under the effect of the combined weight of the formwork and frame assembly.

In a further aspect, the invention may include a frame assembly for supporting a separable concrete formwork during pouring and curing of concrete, the separable formwork being secured to the frame assembly using fasteners or clips, the frame assembly comprising a lower frame portion that is floor or ground engaging and an upper frame portion that is moveable up or down with respect to the lower frame portion, wherein the lower frame portion has four tubular legs and the upper portion has four legs, each one of which locates within and moves up and down telescopically with respect to a leg of the lower portion, a plurality of spaced apart legs, and at least one adjustable foot assembly associated with at least one of the legs, the at least one adjustable foot assembly being adapted to selectively extend or retract relative to its associated leg, and wherein, in use, retraction of at least one foot strips the formwork from cured concrete using the combined weight of the formwork and the frame assembly.

The invention will have numerous applications in the forming of concrete. The invention is equally suited to the formation of vertical surfaces as well as horizontal surfaces but the invention is particularly suited to the formation of horizontal concrete members such as floors in a multi-storey building. The frame may comprise a lower frame portion that is floor or ground engaging and an upper support portion that is moveable up or down in relation to the lower frame portion. The upper support portion is designed to support and hold the concrete formwork in its first uppermost position and to allow lowering of the formwork to the second position by moving the upper support portion with respect to the lower frame portion.

In this respect, before explaining at least one embodiment of the invention in detail, it is to be understood that the invention is not limited in its application to the details of construction and to the arrangements of the components set forth in the following description or illustrated in the drawing. The invention is capable of embodiments in addition to those described and of being practiced and carried out in various ways. Also, it is to be understood that the phraseology and terminology employed herein, as well as the abstract, are for the purpose of description and should not be regarded as limiting.

The accompanying drawings, which are incorporated in and constitute a part of this specification, illustrate certain embodiments of the invention, and together with the description, serve to explain the principles of the invention.

Those skilled in the art will appreciate that the conception upon which this disclosure is based may readily be utilized as a basis for designing other structures, methods, and systems for carrying out the several purposes of the present invention. It is important, therefore, to recognise that the claims should be regarded as including such equivalent constructions insofar as they do not depart from the spirit and scope of the present invention.

BRIEF DESCRIPTION OF THE DRAWINGS

For a better understanding of this disclosure it will now be described with respect to an exemplary embodiment which shall be described herein with the assistance of drawings wherein.

DETAILED DESCRIPTION

Figure 1:
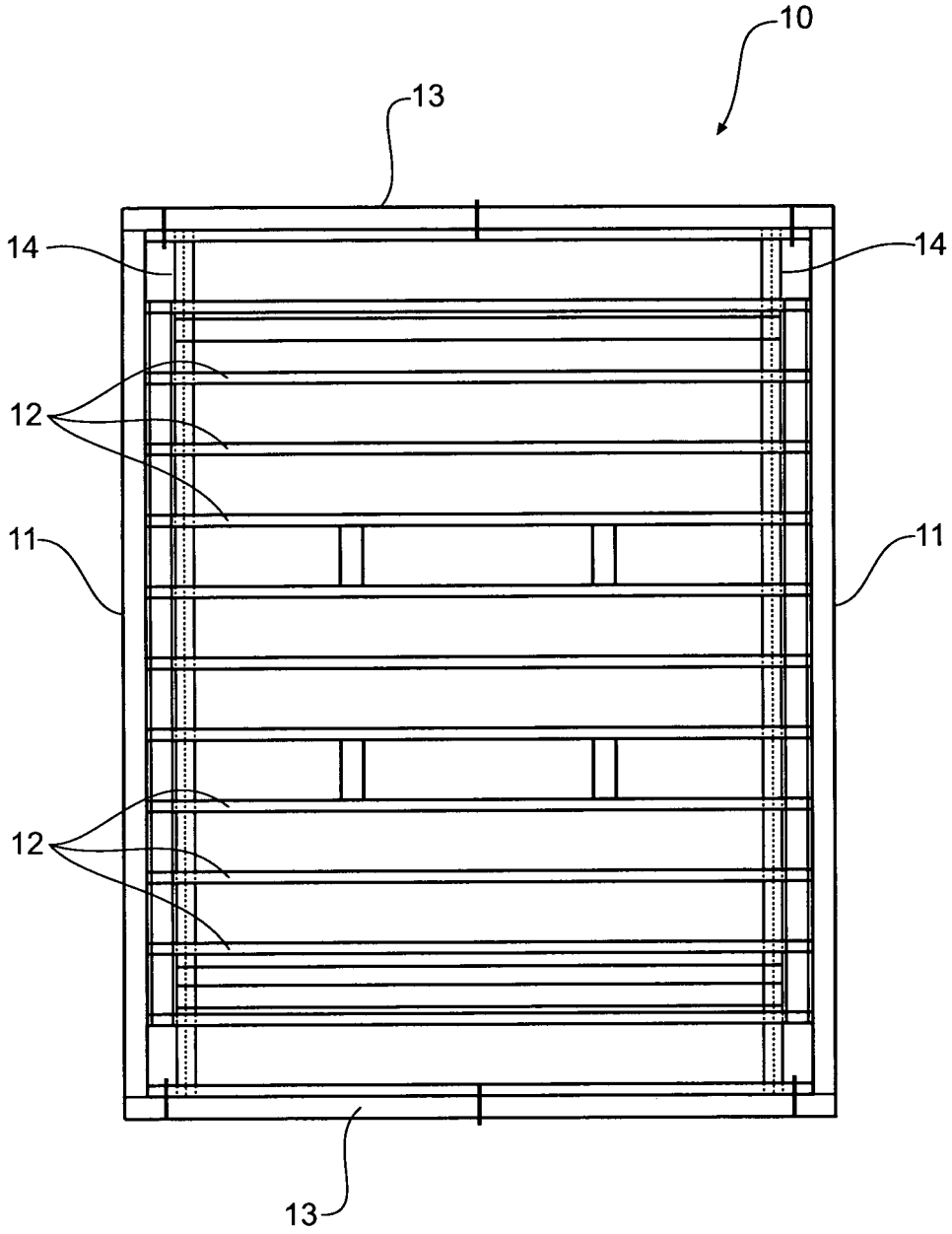
FIG. 1 shows a plan view of a frame assembly for supporting formwork.

Referring to FIG. 1, where there is illustrated a table form frame assembly 10 on which plywood formwork is placed and secured by using fasteners or clips to form a surface for casting concrete. The frame assembly 10 is rectangular and has perimeter beams 11 between which a plurality of joists 12 extend. End beams 13 are parallel to the joists 12 and are secured to the perimeter beams 11. A pair of joist bearers 14 that are parallel and spaced inwardly from the perimeter beams 11 are located underneath the joists 12 and are used to support the framework 10.

The lower frame portion 16 comprises four corner legs 17 of square tubing. End and side rails 18, 19 extend between each of the corner legs 17 and are welded to the upper ends of the corner legs 17. Batons 20 are welded at each end to the corner leg 17 and a respective end or side rail 18, 19 to provide bracing support for the corner legs 17 with respect to the end and side rails 18, 19.

Below the end rails 18 at each end of the lower frame portions 16, there is a pair of lower rails 21 welded on either side at their ends to the corner legs 17.

The upper support portion 23 comprises four tubular supports 24 which are telescopically located within each of the corner legs 17. The supports 24 at each end of the lower frame portions 16 have a beam 25 extending between and secured to the upper ends of the supports 24. A bracket 26 is provided at the top of each support 24 to which the beam 25 is secured to by a removable metal pin 27. The bracket 26 supports both the beam 25 and the joist bearers 14. The joist bearers 14 are also releasably secured with respect to the bracket 26.

In this manner, the framework 10 is supported by and secured to the upper support portion 23 and the upper support portion 23 is in turn supported by the lower frame portion 16. A hydraulic actuator 30 is provided at each end of the lower frame portion 16. The hydraulic actuator 30 comprises a hydraulic cylinder (not drawn) which is located within two telescoping tubular portions. These tubular portions comprise a lower tube 31 and an upper tube 32 that telescopically slides within the lower tube 31.

Figure 2A:
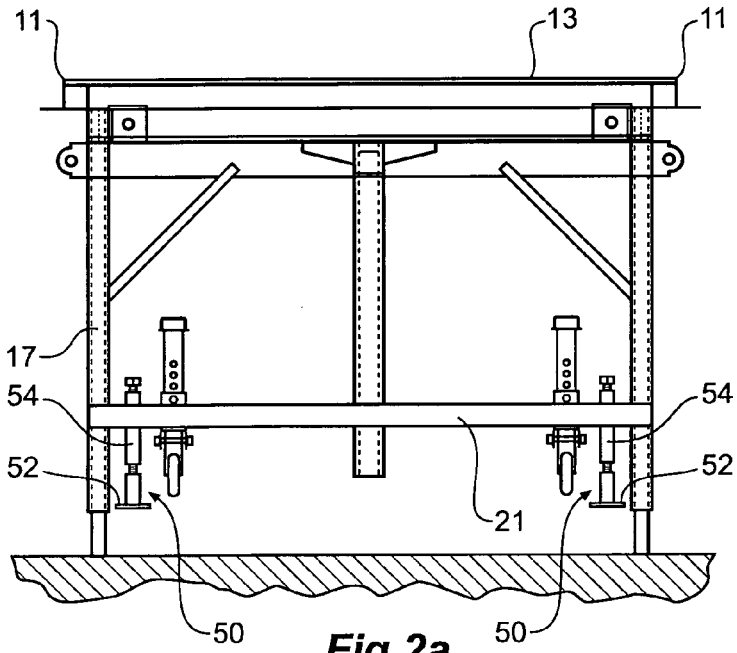
FIGS. 2*a*, and 2*b* show side elevation views of lower frame and upper support portions used to support the table formwork support in extended and retracted positions.
Figure 2B:
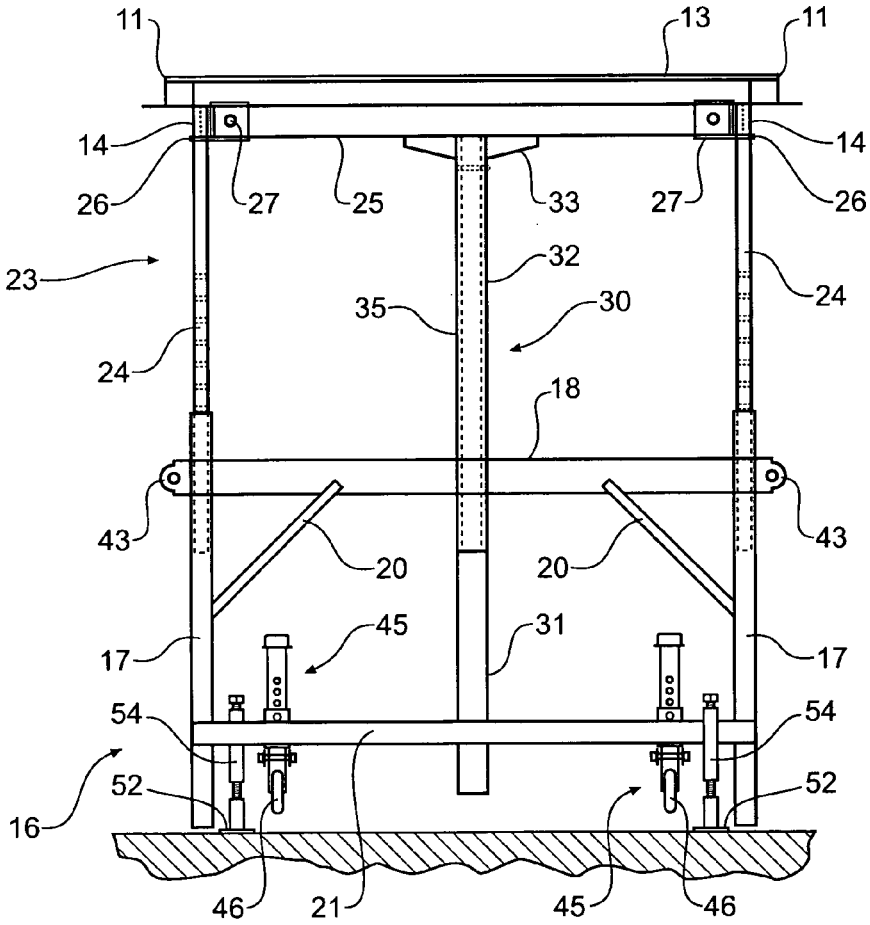

One end of the hydraulic cylinder is secured with respect to the lower end of the lower tube 31 and the upper end of the ram that extends out of the hydraulic cylinder is secured internally to the upper end of the upper tube 32. The lower tube 31 is secured between the rails 21 and the upper end of the upper tube 32 is secured via a bracket 33 to the beam 25. The hydraulic actuators 30 are shown in their fully extended positions in FIGS. 2*b* and 3*b* and in their fully contracted positions in FIGS. 2*a* and 3*a*. The hydraulic actuators 30 are used to extend the upper support portion 23 upwardly with respect to the lower frame portion 16. They may also be used to provide a downward force to the upper support portion 23 when the framework 10 is to be pulled away from the concrete surface, however this is rarely necessary.

Figure 5:
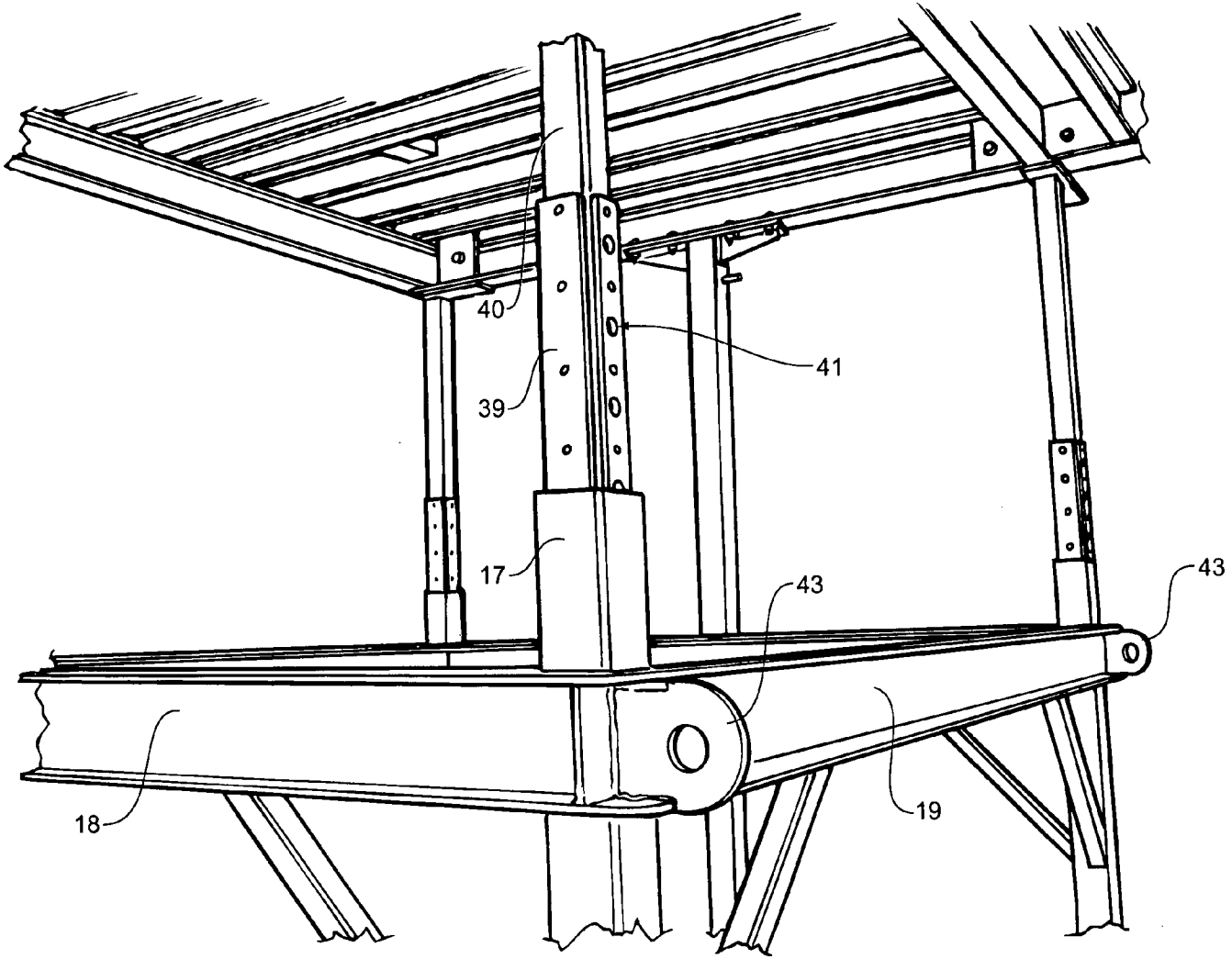
FIG. 5 shows detail of a corner leg on the lower frame portion and a tubular support of the upper frame engaging a leg on the lower frame.
Figure 6:
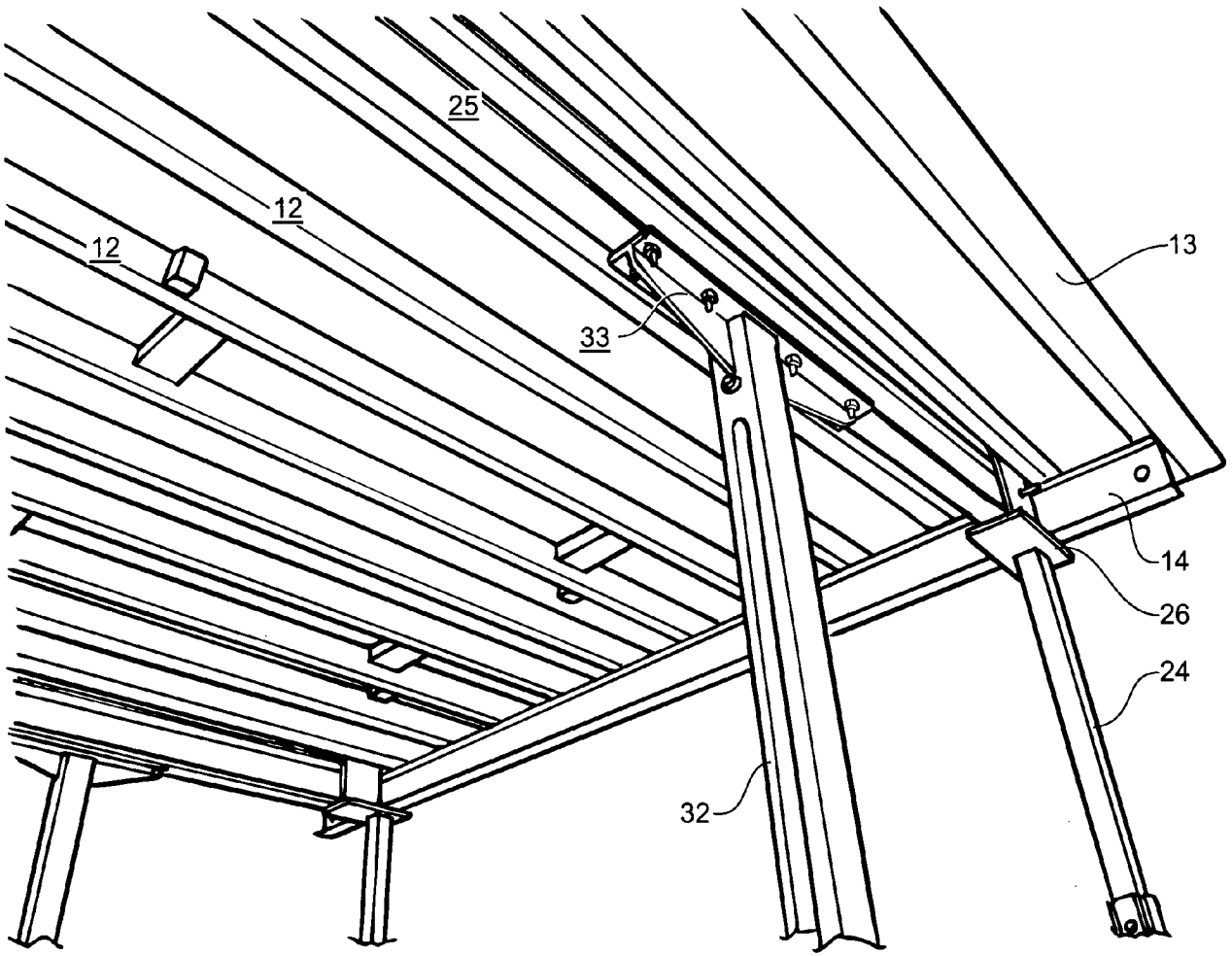
FIG. 6 shows a part underside view of the formwork support, the upper tube of the hydraulic actuator and the brace.

Referring to FIG. 5, the supports 24 may comprise a lowered tube portion 39 and an upper tube portion 40 that telescopically slides within the lower tube portion 39. The lower tube portion 39 and upper tube portion 40 are provided with apertures through which pins may locate to hold the upper tube portion 40 with respect to lower tube portion 39. This enables the height of the upper support portion 23 to be increased or decreased to suit varying heights between floors of different types of buildings. Further, the lower tube portion 39 has a number of apertures 41 along its length through which a pin may locate to secure the supports 24 with respect to each corner leg 17. This enables the load of the upper support portion 23 to be supported by these pin joints rather than on the hydraulic actuators 30 alone.

Brackets 43 are located at each end of each of the end rails 18. These brackets 43 have an aperture therein which enable adjacent lower frame portions 16 to be secured with respect to one another.

Figure 7:
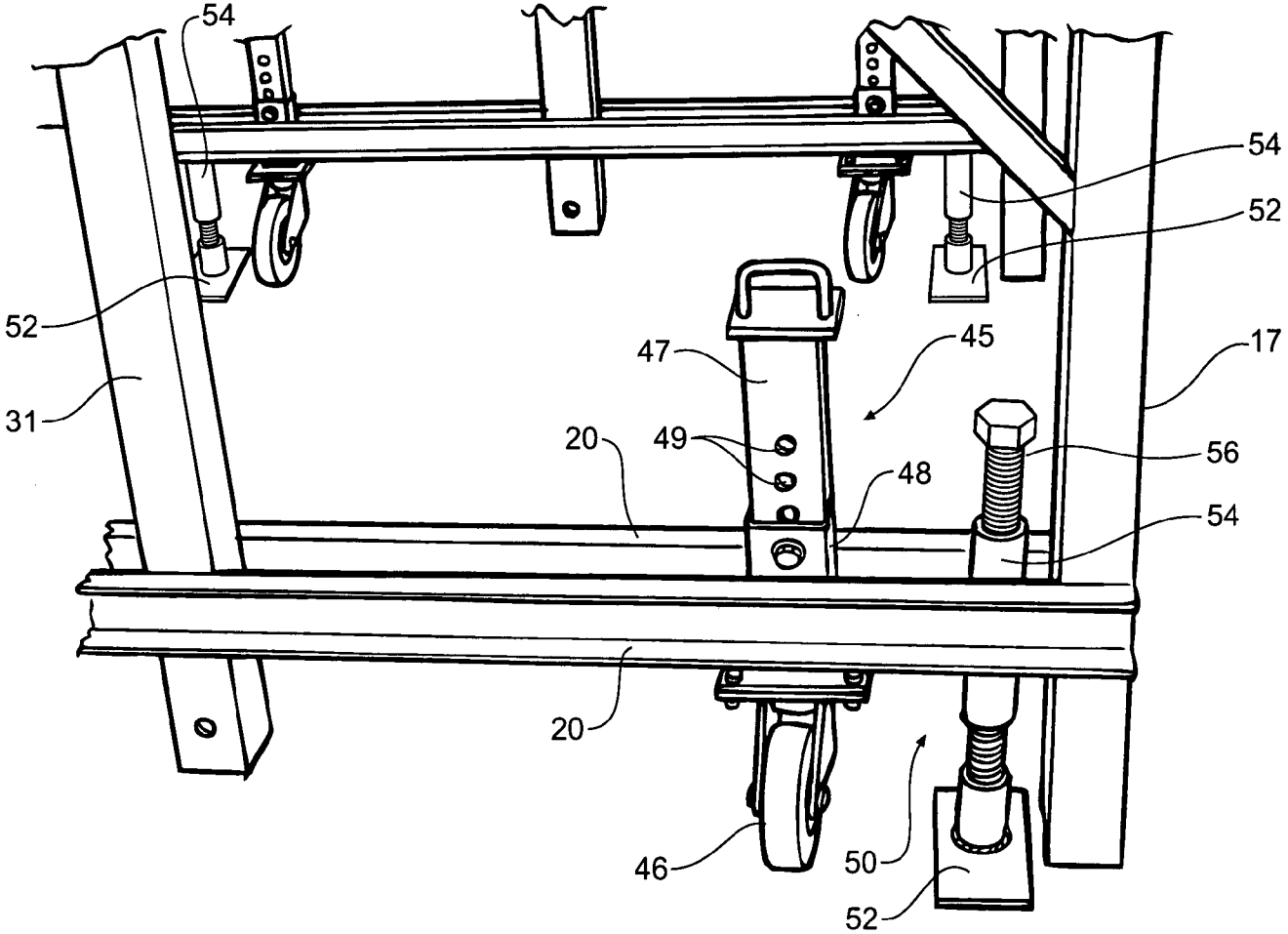
FIG. 7 is a detail view illustrating a castor wheel and jacking support.

Referring to FIG. 7, a pair of castor wheel assemblies 45 are positioned between the rails 21 at each end of the lower frame portions 16. Each of the castor wheels 46 are attached to the lower end of a post 47 which in turn locates through a collar 48. The collar 48 is welded to both of the rails 21 and the post 47 has a series of apertures 49 which align with a corresponding aperture in collar 48 which enables pinning of the post 47 at different heights.

When the hydraulic actuator 30 pulls the upper support portion 23 downwardly, the supports 24, in their lower most position project from the lower ends of the legs 17. This lifts the legs 17 clear of the support surface. In this position, the post 47 can be dropped so that the castor wheel 46 engages the support surface and the post 47 can be pinned in place. The hydraulic actuator 30 is then operated to raise the upper support portion 23 slightly so that the ends of the supports 24 are no longer in engagement with the ground surface. With the ends of the legs 17 clear of the ground surface, the lower frame portion 16 can be moved around readily on the castor wheels 46.

As can be seen from the above description, the combination of the lower frame portion 16 and upper support portion 23 make it very simple to bring into position the table form framework 10 prior to concrete being poured. The castor wheels 46 enable easy movement and positioning of the table form framework 10 at its elevated first position. The castor wheel assemblies 45 can be raised so that the lower frame portion 16 is supported by the corner legs 17 on the floor or ground surface.

FIG. 7 illustrates the foot assemblies 50 in detail; the foot assemblies 50 are secured between the rails 21. Each foot assembly 50 is adapted to extend and retract relative to a nearby leg 17 to enable fine adjustment of the level of the frame assembly 10 at each corner of the lower frame portion 16. Each foot assembly 50 includes a threaded foot 52 that can be screwed into or out of a support 54 so as to extend or retract the foot 52 relative to both the support 54 and the remainder of the frame assembly 10. This enables fine adjustments to be made to bring the framework 10 to an exact level position prior to pouring of the concrete. This means that the load of the formwork and frame 10 is supported by the foot assemblies 50.

Figure 3:
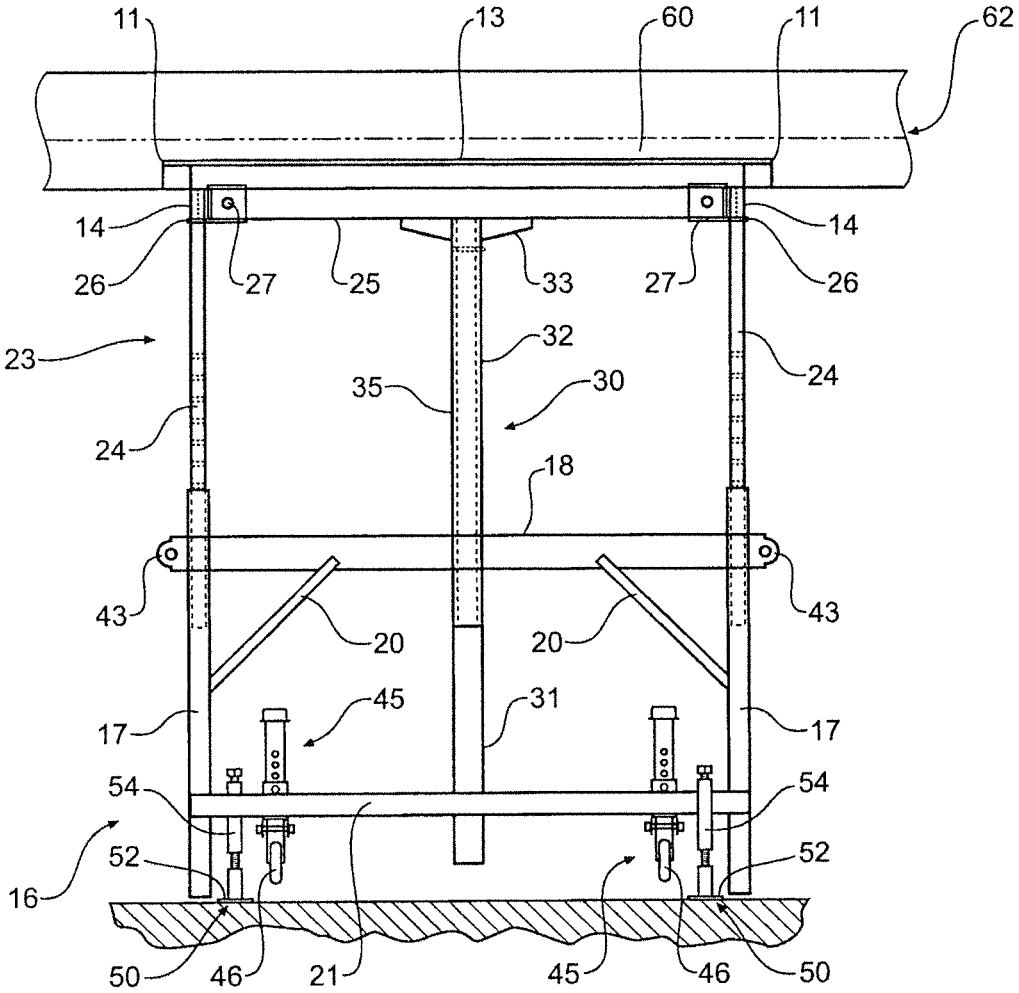
FIG. 3 is a side elevation of the frame assembly supporting formwork and concrete cast therein.
Figure 4:
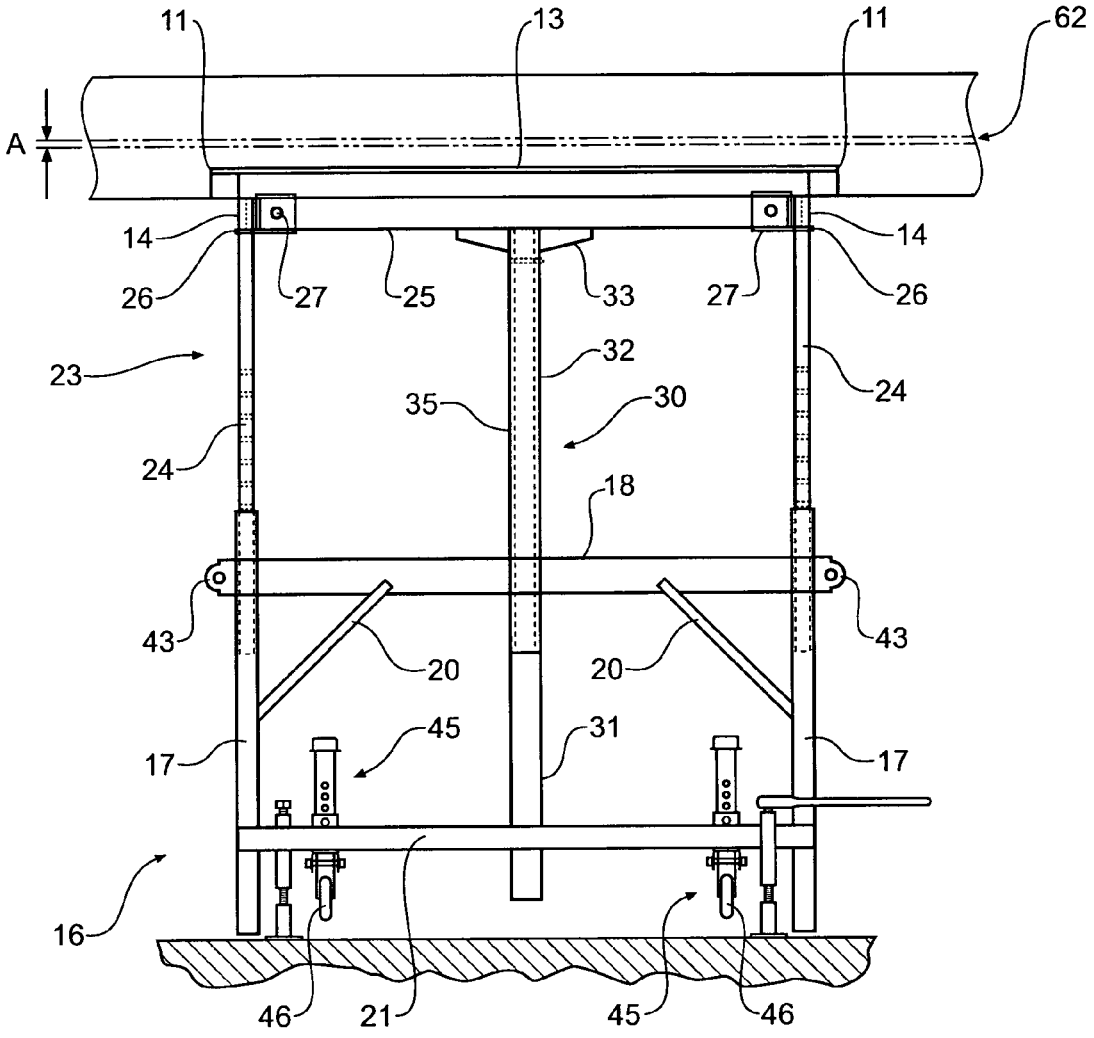
FIG. 4 is a side elevation of the frame assembly stripped (i.e. separated by distance A) from the cured cast concrete.

With reference now to FIGS. 3 and 4, where, after pouring and curing of the concrete, the frame assembly 10 and the formwork 60 supported and retained thereby can be easily stripped away from the concrete surface 62 by retracting the foot assemblies 50 by turning the lead screw 56 for each foot assembly 50 both slightly and gradually until the feet 52 of the formwork supporting frame assembly 10 are clear of the floor surface and the formwork and formwork supporting frame assembly 10 to which the formwork is secured, can fall away from the cured concrete under the effect of the combined weight of the formwork and frame assembly.

When the upper support portion 23 is subsequently returned to its second lower position then the whole assembly can be wheeled easily to the periphery of the building for it to be hoisted to the next level as required. A number of these frame assemblies 10 comprising a lower frame portion 16 and the upper support portion 23 can be assembled together to form the necessary table form between columns which as described above can be quickly positioned prior to concrete being poured and then quickly removed after the concrete has set.

Although the disclosure has been herein shown and described in what is conceived to be the most practical and preferred embodiment, it is recognized that departures can be made within the scope of the invention, which is not to be limited to the details described herein but is to be accorded the full scope of the appended claims so as to embrace any and all equivalent devices and apparatus.

The invention claimed is:

1. A frame assembly supporting a separable concrete formwork during pouring and curing of concrete, the separable formwork being secured to the frame assembly using fasteners or clips, the frame assembly comprising a lower frame portion that is configured to engage at least one of a floor or ground and an upper frame portion that is moveable with respect to the lower frame portion, wherein the lower frame portion has four lower legs configured to engage the floor or ground and the upper frame portion has four legs, each one of the four legs of the upper portion is configured to move telescopically with respect to a respective lower leg of the lower portion, and at least one adjustable foot adjacent to and separate from each of the lower legs of the lower frame portion, each adjustable foot assembly being adapted to selectively extend or retract relative to its associated lower leg with fine adjustment, wherein, in use, each foot assembly is configured to be extended until all of the foot assemblies are in floor or ground contact during pouring and curing, but the lower legs are not, and wherein retraction of at least one foot assembly out of ground or floor contact strips the formwork from cured concrete using the combined weight of the formwork and the frame assembly.

2. The frame assembly of claim 1, wherein each foot assembly comprises a support depending from the lower frame portion, a lead screw threaded into the support, a foot depending from the lead screw, and wherein in use, the lead screw is turned in a first direction relative to the support to extend the foot into contact with the floor or ground, and the lead screw is turned in an opposite direction relative to the support to retract the foot from contact with the floor or ground.

3. The frame assembly as in claim 1, wherein the frame assembly defines an uppermost surface to which the formwork is secured, and this uppermost surface may be leveled by adjusting at least one foot assembly.

4. The frame assembly of claim 3, wherein the uppermost surface of the frame assembly is rectilinear and so defines four corners, and the frame assembly comprises a leg and foot assembly located at or toward each corner.

5. The frame assembly as in claim 1, wherein a hydraulic actuator is positioned between the upper and lower frames and is configured to move the upper frame portion relative to the lower frame portion.

6. The frame assembly of claim 5, wherein two hydraulic actuators are provided at opposing sides of the frame.

7. The frame assembly as in claim 1, wherein the frame assembly further comprises wheel assemblies that can be moved between a ground or floor engaging position and a raised position, and which can support the frame to enable it to be moved when in the engaging position.

8. The frame assembly of claim 7, wherein there is a wheel assembly near each leg.

9. The frame assembly of claim 8, wherein the wheels are castor wheels.

10. A method for stripping concrete formwork from cured concrete using a frame assembly comprising a lower frame portion that is configured to engage at least one of a floor or ground and an upper frame portion that is moveable with respect to the lower frame portion, wherein the lower frame portion has four lower legs configured to engage the floor or ground and the upper frame portion has four legs, each one of the four legs of the upper portion is configured to move telescopically with respect to a respective lower leg of the lower portion, and at least one adjustable foot assembly adjacent to and separate from each of the legs of the lower frame portion, each adjustable foot assembly being adapted to selectively extend or retract relative to its associated leg with fine adjustment, the method comprising the steps of extending each foot assembly so that the foot assemblies are in floor or ground contact during pouring and curing, but the lower legs are not, and then retracting at least one foot assembly out of ground or floor contact to strip the formwork from cured concrete using the combined weight of the formwork and the frame assembly.

11. The method for stripping concrete formwork from cured concrete of claim 10, the method comprising the further step of retracting each foot assembly out of ground or floor contact to strip the formwork from cured concrete using the combined weight of the formwork and the frame assembly.

12. The method for stripping concrete formwork from cured concrete of claim 10, the method comprising the further step of retracting each foot assembly out of ground or floor contact until each of the lower legs is in ground or floor contact.

* * * * *

UNITED STATES PATENT AND TRADEMARK OFFICE

CERTIFICATE OF CORRECTION

PATENT NO. : 8,945,442 B2
APPLICATION NO. : 13/132439
DATED : February 3, 2015
INVENTOR(S) : Rosati It is certified that error appears in the above-identified patent and that said Letters Patent is hereby corrected as shown below:

In the claims:

Column 6,
Line 52, "adjustable foot" should read --adjustable foot assembly--.

Signed and Sealed this
Twenty-seventh Day of October, 2015

Michelle K. Lee

Michelle K. Lee
*Director of the United States Patent and Trademark Office*